United States Patent [19]

Moran et al.

[11] Patent Number: 4,683,152

[45] Date of Patent: Jul. 28, 1987

[54] APPLICATION EQUIPMENT FOR UNIFORM APPLICATION OF WATER-BASED CEMENTS

[75] Inventors: James J. Moran, Sugar Land, Tex.; Russell S. Boyes, Baton Rouge, La.

[73] Assignee: NALCO Chemical Company, Oak Brook, Ill.

[21] Appl. No.: 824,880

[22] Filed: Jan. 31, 1986

[51] Int. Cl.[4] ..... B05D 1/28

[52] U.S. Cl. ..... 427/428; 118/259; 118/266; 156/96; 156/578

[58] Field of Search ..... 427/428; 118/259, 266; 29/121.1, 121.2, 121.5, 121.6, 131; 156/96, 578

[56] References Cited

U.S. PATENT DOCUMENTS

| | | | |
|---|---|---|---|
| 637,565 | 11/1899 | Hett | 29/131 |
| 949,437 | 2/1910 | Munk | 29/121.6 X |
| 1,150,092 | 8/1915 | Anger | 29/131 X |
| 2,281,773 | 5/1942 | Kollmann | 401/197 |
| 2,606,334 | 8/1952 | Vaden et al. | 29/121.2 X |
| 2,751,618 | 6/1956 | Pruitt | 29/131 X |
| 3,658,152 | 4/1972 | Mueller | 118/233 X |
| 3,805,738 | 4/1974 | Kitazawa | 118/259 X |
| 3,946,700 | 3/1976 | Cromeens | 118/259 X |
| 4,458,399 | 7/1984 | Kessler | 427/428 X |
| 4,535,611 | 8/1985 | Masuda | 118/259 |

FOREIGN PATENT DOCUMENTS

| | | | |
|---|---|---|---|
| 3308830 | 9/1984 | Fed. Rep. of Germany | 118/259 |

*Primary Examiner*—Shrive P. Beck

*Attorney, Agent, or Firm*—John G. Premo; Anthony L. Cupoli; Donald G. Epple

[57] ABSTRACT

A roller applicator for applying water-based tire tread adhesive comprising a tube having throughout its length a bore adapted to receive a supply of water-based tire adhesive. The applicator has about its surface a series of parallel spaced-apart grooves which are perpendicular to the length of the roller. These grooves contain holes communicating with the bore. A porous fabric cover capable of being saturated by the water-based tire tread adhesive is fitted around the outside of the tube.

The invention contemplates utilizing a roller of this type in existing plants to apply water-based tire adhesives. It is utilized by being positioned on either side of the Lick Roll in existing adhesive application equipment. Preferably it is the sole source of tire tread adhesive, thereby allowing a bypassing of the Lick Roll.

1 Claim, 3 Drawing Figures

APPLICATION EQUIPMENT FOR UNIFORM APPLICATION OF WATER-BASED CEMENTS

INTRODUCTION

Figure 1:
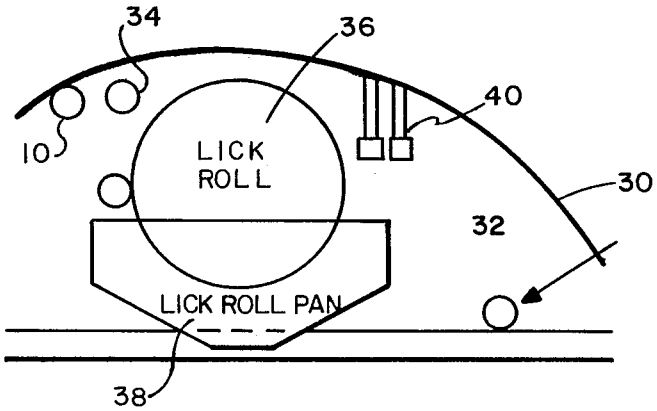
Figure 2:
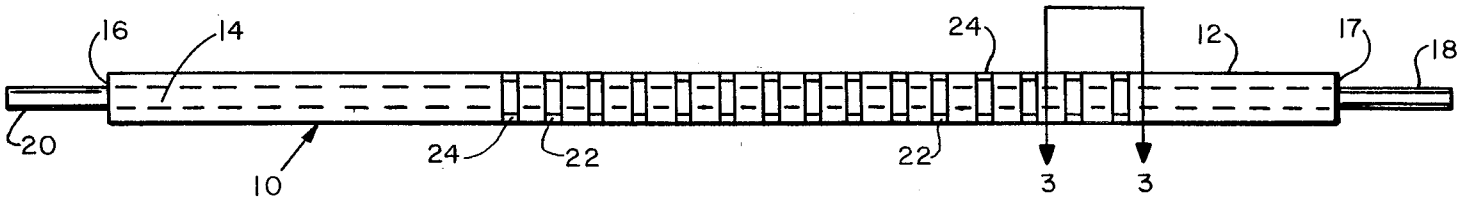
Figure 3:
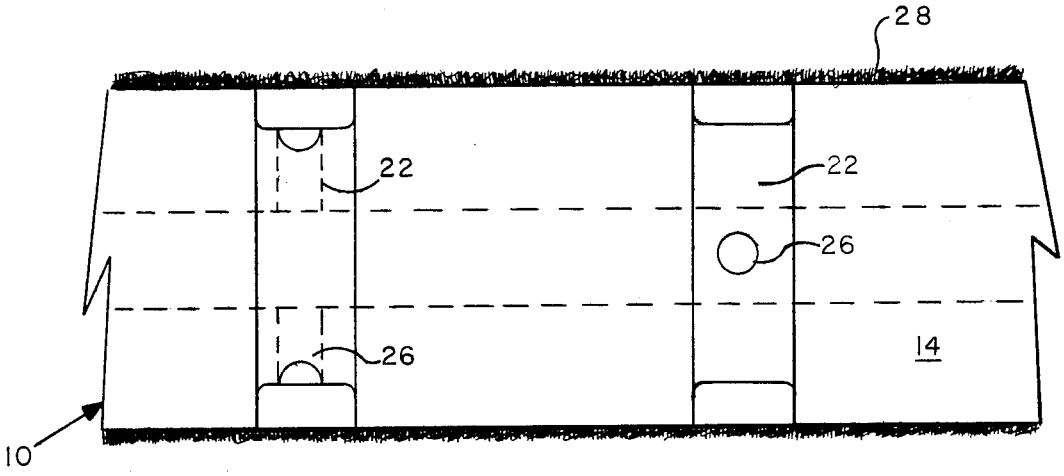

Tire plants have in the past used solvent based cements as tire adhesives. Due to current EPA restrictions on hydrocarbon emissions, they have switched to water-based cements.

As rubber is extruded, the pieces are placed on a conveyor which pass a roller known as the Lick Roll that applies adhesive to the pieces which are collected in a book for assembly.

In existing tire plants in which Lick Rolls have been used to apply an organic solvent-based adhesive to tire stock, e.g. tread stock and side wall stock, such devices do not uniformly apply water-based tire tread adhesives.

These prior art applicators normally consist of a series of drive rolls, guide rolls and the like which convey the stock over the so-called Lick Roll which is a drum applicator. The bottom portion of this roller rests in a pan or reservoir filled with the organic solvent-based adhesive. The Lick Roll picks up adhesive from the reservoir and coats one side of the stock. Immediately following the Lick Roll are brushes which further uniformly spread the coating of adhesive. When such devices are used to apply water-based tire tread adhesives, they do not apply a uniform coating. If it were possible to provide an improved means for applying water-based tire tread adhesives by making a simple modification to existing equipment, a substantial advance in the art of applying water-based tire tread adhesives would be achieved.

THE INVENTION

The invention in its simplest form comprises a roller applicator for applying water-based tire tread adhesives. It comprises a tube having throughout its length a bore adapted to receive a supply of water-based tire tread adhesive. The tube has about its surface a series of parallel spaced-apart grooves which are perpendicular to the length of the tube. These grooves contain holes communicating with the bore. A porous fabric cover capable of being saturated by the water-based tire tread adhesive is fitted around the outside of the tube.

The invention also comprises an improved process for applying water-based tire tread adhesive to tire stock using existing plant equipment of the type now used to apply organic solvent based coating. This old process is of the type comprising drive means for conveying said rubber stock to a Lick Roll for coating adhesive onto said rubber stock. The improvement of this invention comprises utilizing a roller applicator of the type described above. It is located on either side of the Lick Roll and may be adapted to bypass contact with the Lick Roll by the tire stock but not necessarily.

As indicated, the invention is directed to the application of water-based tire tread adhesives to tire stock which includes both tread and side wall stock. Typical of the tire tread adhesives that may be applied in accordance with the type of the invention are those adhesives described in U.S. Pat. No. 4,497,927, the disclosure of which is incorporated herein by reference.

THE DRAWINGS

FIG. I shows a conventional tire tread adhesive applicator such as a Lick Roll positioned in a coating line.

FIG. I further shows the placement of the roller applicator of the invention.

FIG. II is a horizontal view of the roller applicator with the fabric covering removed.

FIG. III is a sectional horizontal view taken across lines 3—3 of FIG. II. Shown in FIG. III is the roller applicator fitted with the porous fabric cover.

In the drawings, like parts have like numerals.

DESCRIPTION OF THE INVENTION

With specific reference to the drawings, and in particular FIGS. II and III, there is shown a roller applicator 10. It is composed of a tube 12 containing throughout its length a bore 14. The ends 16 and 17 are fitted with shaft members 18 and 20.

The shaft 18 is hollow and communicates with the bore 14 and acts as a supply line to feed the water-based tire tread adhesive to the roller applicator 10. The other shaft 20 is solid.

Arranged perpendicularly along the length of the roller applicator 10 are a series of parallel spaced-apart vertical grooves 22 and 24. The grooves contain holes 26. The holes are of such length so as to communicate with the bore 14. To insure an even distribution of the adhesive, the holes 26 are offset in alternate grooves. The offset should be at 90° for best results.

To further insure a uniform application of the adhesive, the outer grooves 24 contain holes 26 of smaller diameter than the diameter of holes 26. Typical diameters of the holes 26 would be $\frac{5}{8}$ inch whereas the other holes 24 would have a diameter of $1\frac{3}{4}$ inch.

In FIG. III the outer surface of the roller 10 is fitted with a porous fabric cover 28 which preferably is a fabricated form medium pile consisting material. Lambs wool and other similar type fabrics may also be used.

FIG. I shows the roller applicator 10 located in a conventional Lick Roll operation. Specifically, the rubber stock 30 is moving in the direction indicated by the arrow. Its bottom 32 is contacted by the roller applicator 10 of the invention which is a journaled in conventional support means (not shown) to allow its free horizontal rotation. Also not shown are conventional supply tanks and piping for supplying the water-based tire tread adhesive to the roller applicator 10. It is to be noted that the roller applicator 10 is positioned so that it bypasses the pre-existing power roller as well as the Lick Roll 36. Also eliminated from the operation is the supply of adhesive usually contained in the Lick Roll pan 38.

Still utilized from the existing equipment are the applicator brushes 40.

By utilizing the roller applicator of the invention in place of the Lick Roll, it is possible to more uniformly apply the water-based adhesive.

Certain modifications of my invention can be made, namely, the roller applicator may be power-driven to act as both an applicator and a power roller. It can be synchronized with the adhesive line to engage and disengage if any problems with the line occur.

Having thus described our invention, we claim:

1. An improved process for applying water-based tire tread adhesive to tire stock, said process being of a type comprising drive means for conveying said rubber stock to a Lick Roll adhesive applicator adapted to apply said adhesive to said rubber stock, the improvement which comprises providing a supply of tire tread adhesive to a roller applicator located ahead of the Lick Roll, which roller applicator bypasses contact of the tire stock with the Lick Roll, said roller applicator being characterized as comprising a tube having throughout its length a bore adapted to receive a supply of water-based tire tread adhesive, said roller applicator having about its surface a series of parallel spaced-apart grooves which are perpendicular to the length of the tube and which grooves contain holes communicating with the bore, and a porous fabric cover fitted around the outside of the tube, said cover being in communication with said supply of tire tread adhesive and saturated by the water-based tire tread adhesive; and transferring the tire adhesive to the tire stock.

* * * * *